United States Patent [19]

Roos et al.

[11] 4,411,761

[45] Oct. 25, 1983

[54] SPINEL-CONTAINING ELECTRODE AND PROCESS FOR ITS PRODUCTION

[75] Inventors: Hans Roos, Bad Durkheim; Hugo Böehn, Ludwigshafen; Knüt Bittler, Speyer; Volker Kiener, Weisenheim; Gerd Wunsch, Speyer, all of Fed. Rep. of Germany

[73] Assignee: BASF Aktiengesellschaft, Ludwigshafen, Fed. Rep. of Germany

[21] Appl. No.: 276,985

[22] Filed: Jun. 24, 1981

[30] Foreign Application Priority Data

Jun. 28, 1980 [DE] Fed. Rep. of Germany ..... 3024611

[51] Int. Cl.[3] ..... C25B 1/26; C25B 11/04

[52] U.S. Cl. ..... 204/290 R; 204/290 F; 204/291

[58] Field of Search ..... 204/290 F, 290 L, 291, 204/290 R

[56] References Cited

U.S. PATENT DOCUMENTS

| | | | |
|---|---|---|---|
| 3,977,958 | 8/1976 | Caldwell et al. | 204/252 |
| 4,039,417 | 8/1977 | Sasaki et al. | 204/196 |
| 4,132,619 | 1/1979 | Klein et al. | 204/242 |
| 4,142,005 | 2/1979 | Caldwell et al. | 427/126 |
| 4,169,028 | 9/1979 | Yokoyama et al. | 204/147 |
| 4,302,321 | 11/1981 | DeNora et al. | 204/291 |

FOREIGN PATENT DOCUMENTS

| | | | |
|---|---|---|---|
| 8476 | 3/1980 | European Pat. Off. | 204/291 |
| 2320883 | 11/1973 | Fed. Rep. of Germany . | |
| 98838 | 7/1973 | German Democratic Rep. . | |

*Primary Examiner*—F. Edmundson

*Attorney, Agent, or Firm*—Keil & Witherspoon

[57] ABSTRACT

In an electrode suitable for electrolysis of aqueous sodium chloride or potassium chloride solutions, at least the outer layer contains spinels, specifically a mixture of the individual spinels of iron and of cobalt, the weight ratio of iron spinels: cobalt spinels being from 30:70 to 90:10.

The electrodes are produced by applying a powder mixture of iron spinel and cobalt spinel to a substrate by a plasma spraying process wherein argon is used as the plasma gas and the spraying energy is from 6 to 30 kW.

2 Claims, No Drawings

SPINEL-CONTAINING ELECTRODE AND PROCESS FOR ITS PRODUCTION

In the production of chlorine or of chlorine compounds by electrolysis of aqueous sodium chloride or potassium chloride solutions, titanium anodes, having an active layer containing noble metal, or graphite electrodes, are nowadays generally employed. The dimensionally stable titanium anodes have the advantage, over the graphite electrodes, that their external dimensions do not change during operation. The disadvantage of these anodes is their relatively high cost of production, resulting from the use of noble metal in the active layer.

It is also known that magnetite can be employed as the anode material for the production of chlorine, but this material has a very high overvoltage in respect of chlorine, so that its use was discontinued a considerable time ago, because of the high energy consumption.

However, there have been many attempts to provide electrodes, based on the substantially cheaper iron oxide, and free from noble metal, which on the one hand have a technically and economically satisfactory low deposition voltage and on the other hand also have adequate chemical resistance to chlorine.

Thus, East German Pat. No. 98,838 describes an electrode consisting predominantly of trivalent iron oxide, with the addition of one or more other metal oxides. To produce this electrode, an oxide mixture is obtained from an iron salt solution by carrier precipitation, and this mixture is subsequently compression-molded and sintered in an oxygen-containing atmosphere. Titanium dioxide, zirconium dioxide and/or tin dioxide are mentioned as oxide additives. However, the electrode described has a chlorine evolution potential of 1.65 V measured against a saturated calomel electrode, at a current density of 1 $kA/m^2$, which, relative to the standard hydrogen potential, corresponds to a chlorine evolution voltage of 1.9 V. With increasing current density, the evolution potential increases substantially, so that at the current densities of from 1.5 to 2.0 $kA/m^2$ nowadays conventionally employed in industrial plant, this electrode gives an unacceptably high evolution potential.

German Laid-Open Application DOS No. 2,320,883 describes anodes which consist of sintered bodies having the structure of a spinel of the general formula $M_xFe_{3-x}O_4$ and which are supposedly suitable for use as chlorine anodes. In this formula, M is a metal from the group comprising manganese, nickel, cobalt, magnesium, copper, zinc and/or cadmium and x is from 0.05 to 0.4. Particular attention is drawn, in this publication, to the improved corrosion resistance of the electrodes compared to conventional magnetite electrodes, whilst no mention is made of the evolution potentials which are essential in assessing an electrode. As our own investigations have shown (cf. Comparative Example 1), these evolution potentials are, at industrially conventionally used current densities of 1.5 $kA/m^2$, from about 1,750 mV to 2,000 mV (measured against a standard hydrogen electrode).

U.S. Pat. Nos. 3,977,958 and 4,142,005 describe electrodes which consist of an electrically conductive substrate onto which a single-metal spinel of the formula $Co_3O_4$ is applied as the electrochemically active substance; the spinel can additionally contain modifying oxides of groups IIIB-VIIB or IIIA-VA or of the lanthanides or actinides. However, the evolution potentials of these electrodes once again do not conform to industrial requirements.

It is an object of the present invention to provide electrodes whose electrochemically active layer contains spinels and which are in particular suitable for use as anodes for the deposition of chlorine in electrolysis cells and exhibit not only good corrosion resistance to the electrolytes and the electrolysis products, coupled with long life, but also a low evolution voltage for chlorine.

We have found that this object is achieved by providing a spinel-containing electrode in which the spinels consist of a mixture of the individual spinels of iron and cobalt in a weight ratio of iron spinel: cobalt spinel of from 30:70 to 90:10.

It is essential that the electrode according to the invention should contain the two spinels as individual spinels and that these should not form a mixed spinel. The presence of the two substances side by side can be demonstrated in a conventional manner by X-ray structural analysis.

Preferably, the active layer contains the two spinels in a weight ratio of $Fe_3O_4$:$Co_3O_4$ of from 40:60 to 70:30.

The active layer can be applied to an electrically conductive base, for example a valve metal, graphite or magnetite. It is, however, also possible to dispense with this substrate entirely, ie. to have an electrode whose entire thickness consists of the active layer.

The electrodes according to the invention are produced under conditions where mixed spinel formation cannot take place; this requires special conditions since $Co_3O_4$ tends to change easily into divalent cobalt oxide and conversely $Fe_3O_4$ tends to change easily into trivalent iron oxide, with formation of a cobalt-iron mixed spinel.

A suitable process for achieving the requisite conditions is plasma spraying. For this, the two spinel powders are mixed thoroughly before use. Advantageously, the powders should have particle sizes of from 10 to 200 $\mu m$, preferably of $<125$ $\mu m$. The mixture is then introduced into the stock vessel of a plasma spray gun, taking care that no phase separation occurs either at that stage or during transportation. Coating can be carried out with a conventional plasma spraying unit, suitable carrier gases being argon by itself or mixed with up to 10% by volume of hydrogen. It is furthermore important that the plasma spraying unit should be operated at a low energy level, ie. that values of 30 kW are not exceeded, though, for design reasons, the value should also not be less than 6 kW.

The body to be coated is first degreased in a conventional manner, after which the surface is prepared by sand-blasting, pickling and the like.

The distance between the plasma flame and the body to be coated should advantageously be from 7 to 12 cm. The plasma flame is moved to and fro in front of the body to be coated until the spray coating has reached the desired thickness. The active coating is effective even at a relatively low thickness of from 20 to 30 $\mu m$, but of course substantially thicker layers are also acceptable, including, in the extreme, electrodes which consist exclusively of the electrochemically active material.

To increase the rate of application achieved with the plasma spraying unit, a powder of a valve metal can also be added to the spinel mixture to be sprayed. Of course, other substances can also be added, where specific properties are desired and where these other substances do not interfere with the electrochemical activity of the spinel layer.

The electrodes according to the invention, employed as anodes in the electrolysis of aqueous alkali metal chloride solutions, show a chlorine evolution potential, at current densities of 0.15 kA/m$^2$, of 1,395 mV, against a standard hydrogen electrode, ie. the overvoltage is only about 35 mV. However, even at the higher current densities of from 1.5 kA/m$^2$ to 6 kA/m$^2$, which are of particular interest industrially, the electrodes are characterized by a low overvoltage, the evolution potentials being, at 1.5 kA/m$^2$, from about 1,450 to at most about 1,600 mV, depending on the substrate. In contrast, East German Patent 98,838 quoted earlier, gives evolution potentials, at the lower current density of 1.0 kA/m$^2$, of from 1,650 to 1,730 mV, measured against a calomel electrode, which corresponds to a potential of about 1,900-1,980 mV against a standard hydrogen electrode.

Furthermore, the electrodes according to the invention have good chemical resistance and mechanical strength, and even when using graphite as the substrate virtually no erosion is noted even after lengthy operation.

The chlorine evolution potentials mentioned in the Examples were measured against a standard hydrogen electrode.

EXAMPLE 1

(a) A mixture of $Fe_3O_4$ and $Co_3O_4$ in the weight ratio 70:30 is applied, by means of a plasma torch, to a titanium expanded metal grid (11×6×2×1×1.5 mm) which has a geometrical surface area of about 20 cm$^2$ and is provided with a central electrical lead made of titanium. Powders having a particle size of <125 μm are used, with argon as the carrier gas, and with a spray energy of 18 kW. After executing 3 spraying cycles on each face, from a distance of 90 mm, the coating thickness 30 μm.

(b) A mixture of $Fe_3O_4$ and $Co_3O_4$ in the weight ratio 50:50 is applied under otherwise identical conditions.

(c) A mixture of $Fe_3O_4$ and $Co_3O_4$in a weight ratio of 30:70 is applied under otherwise identical conditions.

The anodes produced in this way are subjected to current/voltage test under the operating conditions of a chlorine/alkali electrolysis. The following evolution potentials (against a standard hydrogen electrode) are found:

| Current density (in kA/m$^2$) | | 0.15 | 1.5 | 3.0 | 6 |
|---|---|---|---|---|---|
| | | Chlorine evolution potential, mV | | | |
| (a) $Fe_3O_4$:$Co_3O_4$ | 70:30 | 1422 | 1577 | 1672 | 1822 |
| (b) $Fe_3O_4$:$Co_3O_4$ | 50:50 | 1440 | 1535 | 1595 | 1685 |
| (c) $Fe_3O_4$:$Co_3O_4$ | 30:70 | 1452 | 1572 | 1637 | 1757 |

EXAMPLE 2

(a) The anode is produced as described in Example 1, using, as the plasma gas, a mixture of 90% by volume of Ar and 10% by volume of $H_2$, at a spraying energy of 17.2 kW. The weight ratio $Fe_3O_4$:$Co_3O_4$ is 90:1, and the particle size is <125 μm. The current/voltage test gives the following results:

Current density: 0.15 kA/m$^2$—1.5 kA/m$^2$

Evolution potential: 1508 mV—1669 mV.

(b) Using pure argon as the plasma gas, and a spraying energy of 19.2 kW, anodes which show the following potentials are obtained:

Current density: 0.15 kA/m$^2$, 1.5 kA/m$^2$,

Evolution potential: 1513 mV, 1650mV.

EXAMPLE 3

An active layer of $Fe_3O_4$:$Co_3O_4$ in the weight ratio 70:30 is applied to a base of electro-graphite, the electrode having dimensions of 20×15×10 mm. The carrier gas is argon, the spraying energy is 18 kW and the distance of the plasma flame from the electrographite base is 9 cm.

Determination of the evolution potential gives the following results:

Current density: 0.15 kA/m$^2$, 1.5 kA/m$^2$,

Evolution potential: 1395 mV, 1458 mV.

The values obtained, under identical conditions, using the base without activation, are:

Current density: 0.15 kA/m$^2$, 1.5 kA/m$^2$,

Evolution potential: 1475 mV, 1785 mV.

EXAMPLE 4

A powder mixture of $Fe_3O_4$: $Co_3O_4$ in the weight ratio of 2:1, to which 70% by weight of titanium powder has been added, is sprayed onto an aluminum panel, of size 20×15×1.5 mm, by means of a plasma flame, using argon as the carrier gas, at a spraying energy of 17 kW and with 10 cm distance of the plasma flame from the base. When a layer 1.5 mm thick has been produced, the coating process is discontinued, the sprayed layer is detached from the aluminum and the negative shape thus produced is used as the electrode. The following evolution potentials are found:

Current density: 0.15 kA/m$^2$, 1.5 kA/m$^2$,

Evolution potential: 1484 mV, 1583 mV.

COMPARATIVE EXAMPLE 1

Compounds of the type $M_xFe_{3x}O_4$ (A=$Co_{0.3}Fe_{2.7}O_4$ and B=$Co_{0.4}Fe_{2.6}O_4$, as described in German Laid-Open Application DOS 2,320,883) are applied, similarly to Example 1, by means of a plasma spray gun onto an anode base made of titanium, like that described in Example 1, and the evolution potentials are determined under the same conditions as described in Examples 1 to 4.

The following values are found:

Current density: 0.15 kA/m$^2$, 1.5 kA/m$^2$,

Type A: 1343 mV, 2013 mV,

Type B: 1418 mV, 1808 mV.

A comparison of these evolution potentials, measured at 1.5 kA/m$^2$, with those measured with the electrodes according to the invention in Examples 1 to 4 shows a difference of more than 250 mV.

COMPARATIVE EXAMPLE 2

An electrode is produced by the method described in Example 1, but using pure $Co_3O_4$ (in accordance with U.S. Pat. No. 3,977,958). The current/voltage test gives the following results:

Current density: 1.5 kA/m$^2$,

Evolution potential: 1775 mV. p This electrode, again, shows a evolution potential, at 1.5 kA/m$^2$, which is about 200 mV higher than that of the electrodes according to the invention.

COMPARATIVE EXAMPLE 3

The anode is produced as described in Example 1, using argon as the plasma gas, at a spraying energy of 32 kW. The weight ratio $Fe_3O_4$:$Co_3O_4$ is 70:30, the particle size being $<125$ $\mu$m. The evolution potential is determined under the same conditions as in Examples 1 to 4. The following values are found:

Current density: 0.15 kA/m$^2$, 1.5 kA/m$^2$,

Evolution potential: 1510 mV, 1750mV.

A comparison of these evolution potentials with those of the electrode according to Example 1*a*, whose active layer has been produced at a spraying energy of 18 kW, shows that the evolution potential at the latter electrode is from 90 to 170 mV lower.

We claim:

1. An electrode of which at least the outer electrochemically active layer contains spinels, wherein the spinels consist of a mixture of the individual spinels of said iron and said cobalt, $Fe_3O_4$ and $Co_3O_4$ spinels being from 30:70 to 90:10.

2. An electrode as claimed in claim 1, wherein the weight ratio of iron spinel:cobalt spinel is from 40:60 to 70:30.

* * * * *

UNITED STATES PATENT AND TRADEMARK OFFICE

CERTIFICATE OF CORRECTION

PATENT NO. : 4,411,761

DATED : Oct. 25, 1983

INVENTOR(S) : ROOS ET AL

It is certified that error appears in the above-identified patent and that said Letters Patent are hereby corrected as shown below:

Col. 6, line 6, Claim 1: after "of", second occurrence, should read -- $Fe_3O_4$ and $Co_3O_4$ spinels, the weight ratio of said iron spinel:said cobalt spinel being from 30:70 to 90:10. --

Signed and Sealed this

*Thirteenth* Day of *March 1984*

[SEAL]

*Attest:*

GERALD J. MOSSINGHOFF

*Attesting Officer*

*Commissioner of Patents and Trademarks*